US005415189A

United States Patent [19]

Sampson et al.

[11] Patent Number: 5,415,189

[45] Date of Patent: May 16, 1995

[54] LIGHTWEIGHT CIGARETTE FILTER AND CIGARETTES INCORPORATING SUCH FILTERS

[75] Inventors: John R. Sampson, Welwyn Garden City; Martin G. Duke, Maldon; Michael P. Parker, Leighton Buzzard; Adrian R. Stewart-Cox, Buckingham, all of England

[73] Assignee: Rothmans International Services Limited, London, England

[21] Appl. No.: 964,867

[22] Filed: Oct. 22, 1992

[30] Foreign Application Priority Data

Oct. 23, 1991 [GB] United Kingdom ..... 9122447

[51] Int. Cl.[6] ..... A24D 3/00; A24D 3/06

[52] U.S. Cl. ..... 131/339; 131/341; 131/344

[58] Field of Search ..... 131/331, 338, 339, 341, 131/342, 344; 156/180; 493/39, 47

[56] References Cited

U.S. PATENT DOCUMENTS

| | | | |
|---|---|---|---|
| 3,607,512 | 9/1971 | Mathe | 156/178 |
| 3,648,712 | 3/1972 | Patterson . | |
| 3,664,352 | 5/1972 | Norman et al. . | |
| 3,905,377 | 9/1975 | Yatrides . | |
| 4,034,765 | 7/1977 | Hall . | |
| 4,189,511 | 2/1980 | Levers et al. | 428/167 |
| 4,222,729 | 9/1980 | Ragazzini et al. | 425/378 R |
| 4,457,319 | 7/1984 | Lamb et al. | 131/340 X |
| 4,550,740 | 11/1985 | Riehl, Jr. | 131/341 X |
| 4,655,736 | 4/1987 | Keith | 493/43 |
| 4,693,265 | 9/1987 | Norman | 131/344 |
| 4,862,905 | 9/1989 | Green, Jr. et al. | 131/84.1 |
| 4,874,004 | 10/1989 | Borowski et al. . | |
| 4,924,888 | 5/1990 | Perfetti et al. | 131/336 |

FOREIGN PATENT DOCUMENTS

| | | |
|---|---|---|
| 0392112 | 10/1990 | European Pat. Off. . |
| 2113066 | 8/1983 | United Kingdom . |
| 2119221 | 11/1983 | United Kingdom . |
| 2135865 | 9/1984 | United Kingdom . |

*Primary Examiner*—Jennifer Bahr

*Attorney, Agent, or Firm*—Diller, Ramik & Wight

[57] ABSTRACT

A lightweight cigarette filter including a filter element containing filter material having a total Denier of less than 35,000 or a bulk density of less than 0.12 $gcm^{-3}$ in which part of the volume of the filter is occupied by a space filler impervious to smoke flow therethrough and the bulk density of which is less than the bulk density of the equivalent amount of filter material which it replaces.

12 Claims, 4 Drawing Sheets

LIGHTWEIGHT CIGARETTE FILTER AND CIGARETTES INCORPORATING SUCH FILTERS

BACKGROUND OF THE INVENTION

This invention relates to a lightweight cigarette filter and to cigarettes incorporating such a filter.

In certain circumstances it is desirable to produce cigarettes which are overall lighter in weight than standard cigarettes. It is difficult to reduce the overall weight of tobacco whilst retaining acceptable characteristics but if a filter is incorporated with the cigarette the Applicants have found that it is possible to reduce the weight of the filter thus reducing the overall weight of the combined tobacco and filter.

SUMMARY OF THE INVENTION

According to the present invention a lightweight cigarette filter includes a filter element containing filter material having a total Denier of less than 35,000 or a bulk density of less than 0.12 $gcm^{-3}$, and in which part of the volume of the filter is occupied by a space filler impervious to smoke flow therethrough and the bulk density of which is less than the bulk density of the equivalent amount of filter material which it replaces.

In one preferred construction the space filler is in the form of a longitudinally extending filler component with a smoke path around at least part of its circumference, thus the filter material can be arranged around the outer longitudinally extending surface of the filler component.

Again, the filter material can be located adjacent the longitudinally spaced apart ends of the filler component. With this arrangement, if desired, an empty space can be provided around the outer longitudinally extending surface of the filler component.

In another convenient construction the space filler is an annular longitudinally extending filler component with a smoke path through its bore and the filter material can be located within said bore.

In another preferred construction a number of filler components are provided in the form of granules located in the filter material. Such granules may conveniently be in the form of spheres.

In one preferred construction the granules are attached to an outer plug wrap.

Preferably the transverse cross-sectional area of the filler component can be less than 50% of the transverse cross-sectional area of the filter.

The filler component can be made in various ways and in one construction can be formed from a closed cell foam, for example from a foamed plastic material such as cellulose acetate, polyolefins (e.g. polyethylene) or foamed starch and/or tobacco dust.

With this arrangement the component can be wrapped in a porous or non-porous plug wrap.

The bulk density of this foam material can be in range 0.01 to 0.05 $gcm^{-3}$ and when in the form of a rod has a diameter, for example, in the range 1.0 to 6.5 mm but is preferably in the range 3 to 5.5 mm. Use of closed cell foamed material provides a barrier to smoke flow and thus all the smoke will flow through the fibrous filter material or through the empty space surrounding the filter component and be filtered through the filter material at its ends.

In another construction the filler component can be formed from expanded ceramics materials such as aluminosilicates.

In an alternative construction the filler component can be formed from a tube of impervious material one or both ends of which are closed, the general effect being the same.

The filter may be in dual or triple form, the filter element extending for only part of the total length of the filter, the remainder being provided by filter material.

If desired the filter can be provided with tip ventilation.

The invention also includes a cigarette incorporating a filter as set forth above.

The invention can be performed in various ways and some embodiments will now be described by way of example and with reference to the accompanying drawings in which:

DESCRIPTION OF THE PREFERRED EMBODIMENTS

Figure 1:
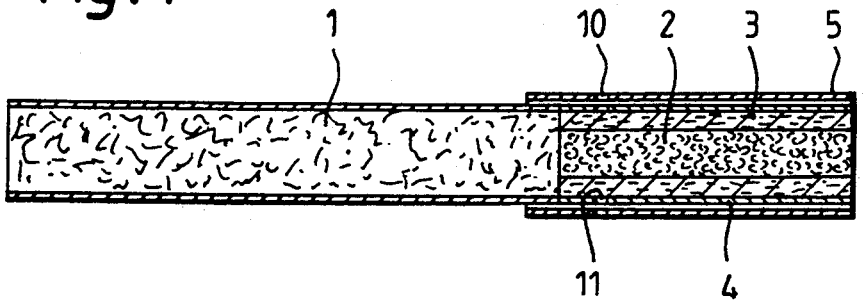
FIG. 1 is a cross-sectional diagrammatic side elevation of a cigarette incorporating a lightweight filter according to the invention.

As shown in FIG. 1 a cigarette in combination with a lightweight filter according to the present invention comprises a tobacco rod 1 and a lightweight filter comprising a filter element which includes a space filler in the form of a filler component 2 made from a closed cell foam and which is surrounded by a fibrous filter material 3 for example cellulose acetate or polypropylene. The filter element is wrapped in a plug wrap 4 which may be non-porous or porous and the filter is attached to the tobacco rod 1 by a tipping paper 5.

The fibrous filter material 3 has a total Denier of less than 35,000 Denier and it will be seen that part of the volume of the filter element is occupied by the space filler component 2. The bulk density of the component 2 is less than the bulk density of the equivalent amount of filter material 3 which it replaces so that the overall weight of the filter is less than if it was merely filled with filter material.

The bulk density of the material used in the filler component 2 can be in the range 0.01 to 0.05 $gcm^{-3}$ and it can have a diameter in the range 1.0 to 6.5 mm but is preferably in the range 3 to 5.5 mm. The use of this closed cell foam material provides a barrier to smoke flow and hence all smoke will flow through the outer annulus of the fibrous material.

In a typical example a cellulose acetate filter 25 mm in length and 7.8 mm in diameter has a weight of 135 mg. When a 5.5 mm core of low weight closed cell foam (bulk density 0.03 $gcm^{-3}$) is used the weight of the filter is reduced by 50 mg, representing a 37% weight saving on filter weight. To achieve the same draw resistance and smoke reducing properties when combined with a tobacco rod a reduced total Denier tow material and the introduction of ventilation can be used, thus ventilation openings 10 can be included in the tipping paper 5 and ventilation openings 11 in the plug wrap 4 or by use of a porous plugwrap.

The cross-sectional area of the filler component 2 is less than 60% of the transverse cross-sectional area of the filter element.

Figure 2:
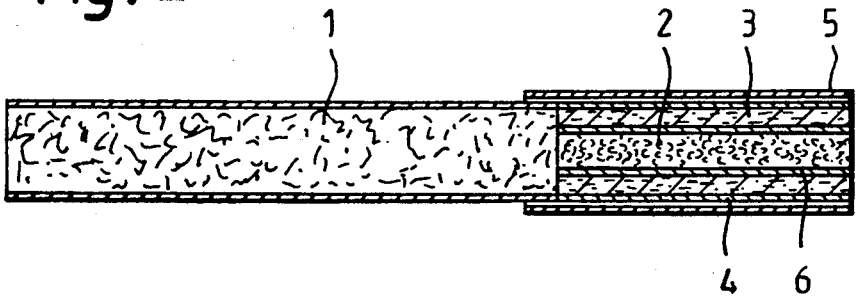
FIG. 2 is a cross-sectional diagrammatic view of an alternative construction; and, FIGS. 3 to 16 are cross-sectional diagrammatic side views of further alternative constructions according to the invention.

FIG. 2 shows a similar construction to FIG. 1 but in this arrangement the closed foam filler component 2 is wrapped in a non-porous or porous plug wrap 6.

Figure 3:
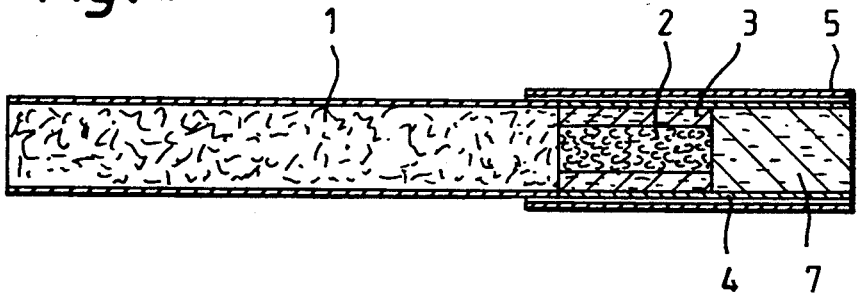

FIG. 3 shows a construction where the filter element extends for only part of the total filter length with a paper, webbed or fibrous filter section 7 to complete the filter either in dual or triple format, thus in triple format a fibrous section 7 will be provided at each spaced apart end of the filter component. The construction of the filter component in this arrangement is similar to that shown in FIG. 1.

Figure 4:
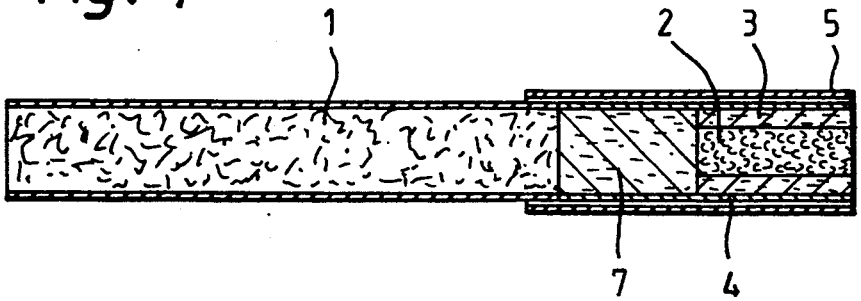

FIG. 4 shows another embodiment with the filter element, again in the form shown in FIG. 1, but in this case the fibrous filter component 7 is shown at the end of the filter adjacent the tobacco rod 1.

Figure 5:
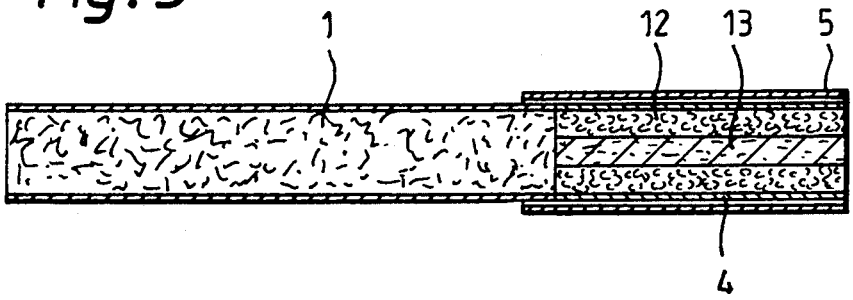
Figure 6:
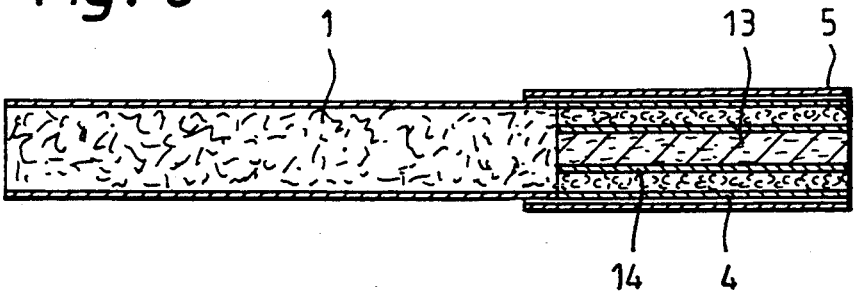
Figure 7:
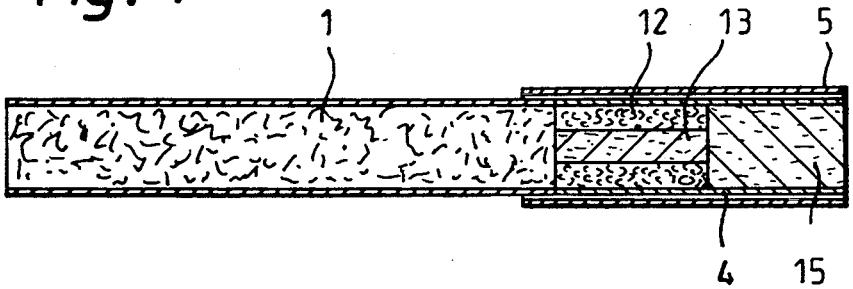

In the construction shown in FIGS. 5, 6 and 7 the same reference numerals are used to indicate similar items but in these constructions the disposition of the filler component and fibrous filter material is reversed. Thus, the filler component 12 is in the form of an annulus surrounding a rod 13 of fibrous filter material. With this arrangement, for example, a typical cellulose acetate filter 25 mm in length and 7.8 mm in diameter has a weight of 135 mg. When 50% of the cellulose acetate volume (0.6 $cm^3$) is replaced with a low weight closed cell foam (bulk density 0.03 $gcm^{-3}$) the weight of the filter is reduced by 50 mg representing a 37% weight saving on filter weight.

The construction shown in FIG. 6 shows the use of a non-porous or porous plug wrap 14 which is wrapped about the fibrous filter material 13.

FIG. 7 shows a construction where the low weight filter section extends for only part of the total filter length with a paper, webbed or fibrous section 15 used to complete the filter in a dual format. Additionally, this filter design may be made in a triple format, that is with a filter section at each end of the filter unit.

Figure 8:
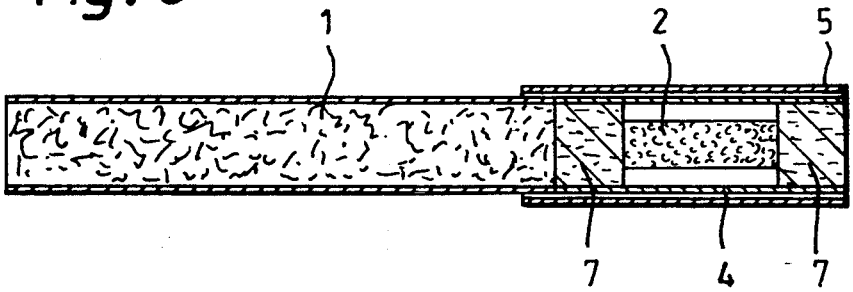

In FIG. 8 the filter element comprises two spaced apart filter sections 7 which are held apart by space filler component 2 of similar construction to that shown in FIG. 1, in this arrangement however the filter component can either be surrounded by a free space as shown or by filter material in the manner shown in FIG. 1.

Figure 9:
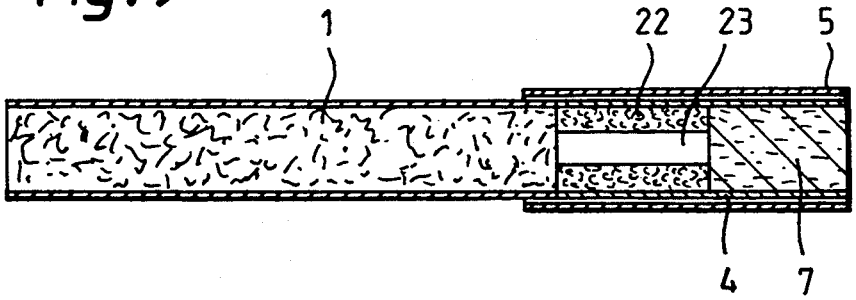

The configuration of the space filler component and free space or filter material shown in FIG. 8 is reversed in FIG. 9, thus in this construction the space filler component 22 is in the form of an annulus and acts as a tube, the filter section core being hollow as indicated by reference numeral 23. FIG. 9 shows a dual format with a fibrous filter section 7 but a triple format can be made with two fibrous filter sections 7 as shown in FIG. 8.

Figure 10:
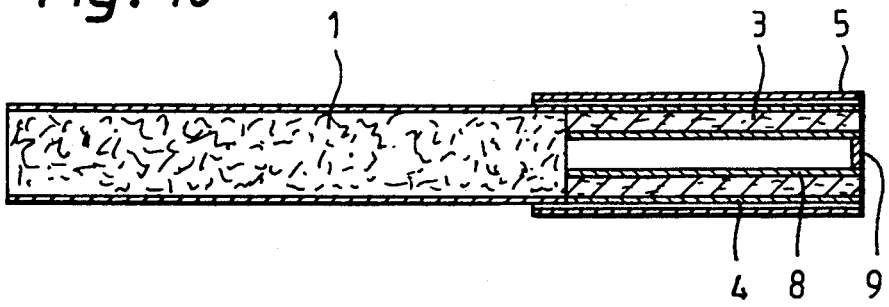

In the construction shown in FIG. 10 the filler component of closed cell foam is replaced by a lightweight tube 8 which is appropriately sealed by a plug 9 at one end. The tube 8 can be made of any suitable lightweight material which is impervious to smoke, for example a plastics material impervious card or Other materials which have the desired effect. As will be seen from FIG. 10 the smoke from the tobacco rod cannot pass through the tube because of the plug 9 but passes through the filter material surrounding it.

The tube 8 could be closed at both ends or at the end adjacent the tobacco rod.

Figure 11:
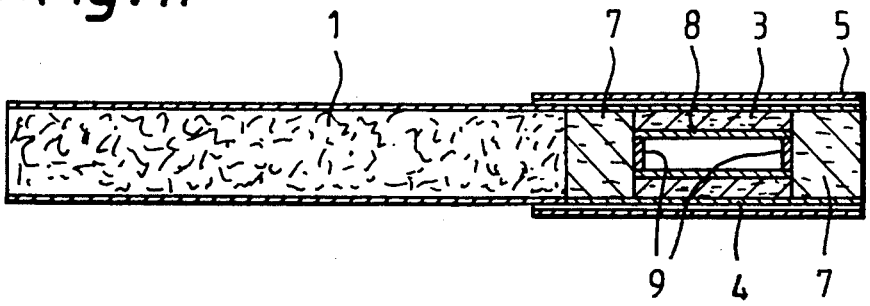
Figure 12:
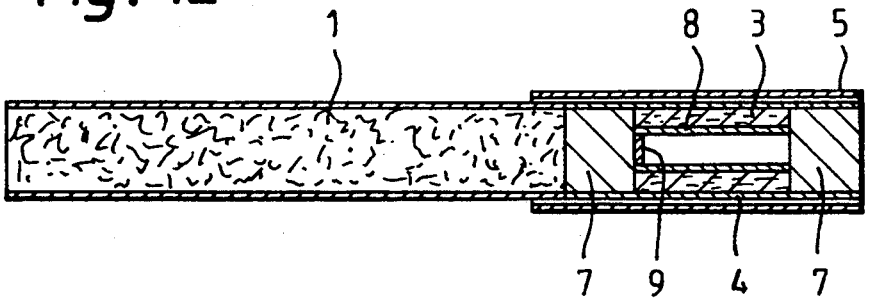
Figure 13:
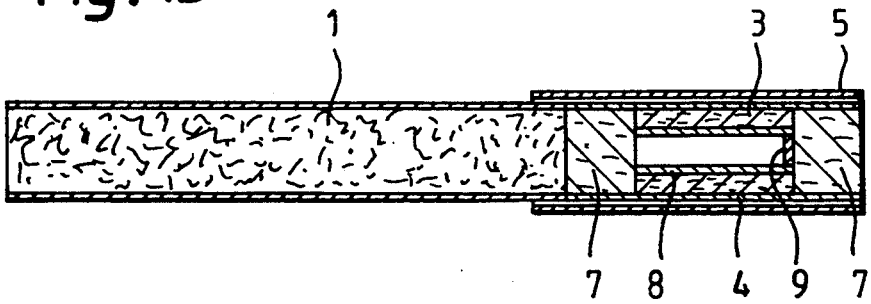

FIG. 11 shows a triple format filter similar to that shown in FIG. 5 but again using a tube 8. In this case both ends of the tube are closed by plugs 9. FIG. 12 shows a similar construction but with only the end of the tube nearest to the tobacco rod closed and FIG. 13 shows a similar construction with the end of the tube adjacent the mouth piece end closed.

It will be appreciated that constructions similar to FIGS. 3 and 4, that is a dual format, can also be made using a closed tube 8 in place of the foamed filler component 2.

Figure 14:
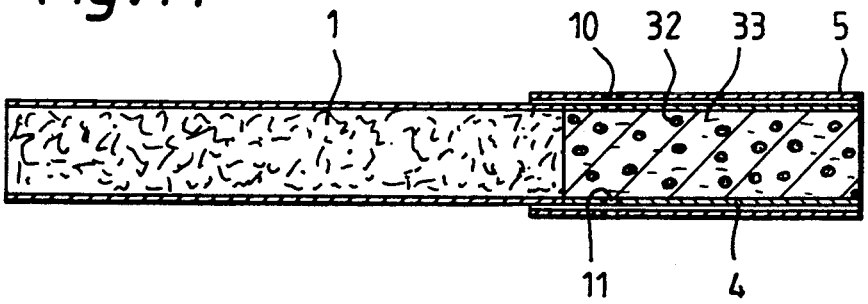

The filter construction shown in FIG. 14 comprises a rod of suitable filter material 33 in which the space filler component is provided by a number of space fillers 34 made from closed cell foam material. These are preferably in the form of spheres of dimensions in the range 1–2 mm diameter and are dispersed within the fibrous material which may, for example, be cellulose acetate, polypropylene or paper. The filter unit is again wrapped in a plug wrap which may be porous or non-porous and held on the tobacco rod by a tipping paper 5. If desired ventilation openings 10 and 11 can again be provided.

Figure 15:
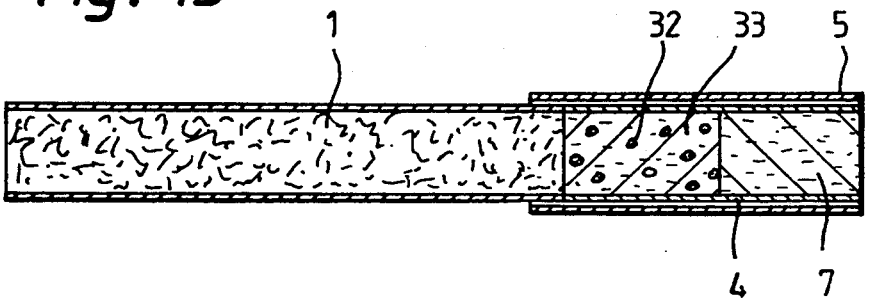

A further embodiment is shown in FIG. 15 where the low weight section extends for only part of the total filter length with paper, webbed or fibrous sections 7 to complete the filter in a dual format. Additionally, this filter design may be made in a triple format in a similar manner to that shown in FIG. 8.

Figure 16:
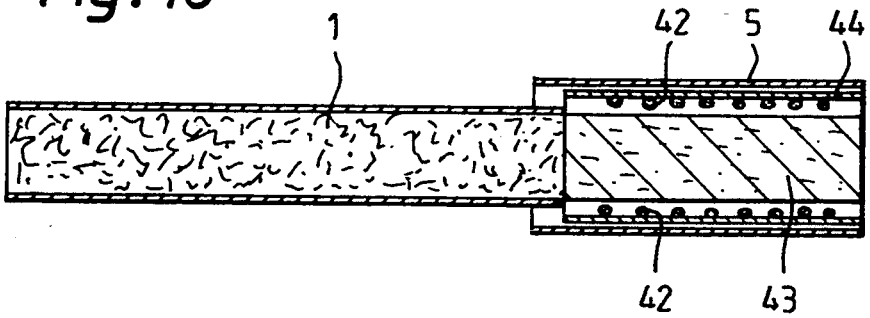

FIG. 16 shows a construction which shows a filter again attached by a tipping paper 5. In the filter section a rod of fibrous material 43 such as cellulose acetate, polypropylene or paper is provided. A plug wrap 44 has small granules 42 of closed cell foam material attached to it on its inner surface. Preferably the granules are provided as spheres of dimensions in the range 1–2 mm diameter. The granules 42 can be applied with glue to the inner surface of the plug wrap 44 in a number of different patterns so as to leave suitable gaps along the length of the filter rod for cutting. This design obviates the need for dual or triple configurations.

The following table shows the percentage of total area and volume occupied by typical foam filler components for filters of 7.8 mm diameter.

It is assumed that the cross-sectional area of 7.8 mm diameter filter is 0.48 $cm^2$ and a 2 cm length of such a filter has a volume of 0.96 cm.

| Core Diameter (mm) | Area ($cm^2$) | Area (%) | Volume ($cm^3$) | Volume (%) |
|---|---|---|---|---|
| 1 | 0.01 | 1.64 | 0.02 | 1.64 |
| 2 | 0.03 | 6.57 | 0.06 | 6.57 |
| 3 | 0.07 | 14.79 | 0.14 | 14.79 |
| 4 | 0.13 | 26.30 | 0.25 | 26.30 |
| 5 | 0.20 | 41.09 | 0.39 | 41.09 |
| 6 | 0.28 | 59.17 | 0.57 | 59.17 |

Tow items, that is the filter material, for use with these filters would be in the range:

| | | | |
|---|---|---|---|
| DPF | 5 to 8 Y | or | 1.5 to 2.7 Y |
| Total Denier | 10000 to 25000 | or | 12000 to 35000 |

For example, with a filter component of 5 mm diameter, a tow item of 6Y/18000 or 5Y/17000 could be used to obtain an acceptable filter pressure drop. In general, as the core diameter increases, the total Denier of the tow would decrease and the Denier per filament would increase. The highest total Denier to be used is 35000.

In a dual or triple configuration, the percentage volume of the insert will depend on the core's diameter and the length used relative to the total length of the filter. For example; in a 20 mm filter comprising a 10 mm section of cellulose acetate and a 10 mm section of filter with the filter component material (FIG. 3), the volume occupied by the core material is 20.5%.

In the constructions described above a fibrous filter material 3 is used but in an .alternative construction the fibrous material could be replaced with, for example, a paper filter material having a bulk density of less than 0.12 $gcm^{-3}$.

Besides replacing the weight of the filter element the use of a filter component helps to prevent hot collapse of the filter during smoking.

Although a preferred embodiment of the invention has been specifically illustrated and described herein, it is to be understood that minor variations may be made in the apparatus without departing from the spirit and scope of the invention, as defined the appended claims.

What is claimed is:

1. A lightweight cigarette filter including a filter element containing fibrous filter material having a total Denier of less than 35,000 or a bulk density of less than 0.12 $gcm^{-3}$ in which part of the volume of the filter is occupied by a closed-cell foam space filler which is substantially completely impervious to smoke flow therethrough and the bulk density of which is less than the bulk density of the filter material.

2. A lightweight cigarette filter as claimed in claim 1 in which the space filler is in the form of a longitudinally extending filler component and a smoke path is defined by said filter element.

3. A lightweight cigarette filter as claimed in claim 2 in which the filter material is arranged around the outer longitudinally extending surface of the filler component.

4. A lightweight cigarette filter as claimed in claim 2 in which the filter material is located adjacent the longitudinally spaced apart ends of the filler component.

5. A lightweight cigarette filter as claimed in claim 1 in which the transverse cross-sectional area of the space filler is less than 60% of the transverse cross-sectional area of the filter.

6. A lightweight cigarette filter as claimed in claim 1 in which the closed cell foam material is cellulose acetate, polyolefins or foamed starch and/or tobacco dust.

7. A lightweight cigarette filter as claimed in claim 6 in which the filter element is wrapped in a plug wrap.

8. A lightweight cigarette filter as claimed in claim 6 in which the bulk density of this foam material is within the range 0.01 to 0.05 $gcm^{-3}$.

9. A lightweight cigarette filter as claimed in claim 8 in which the filter element is in the form of a rod having a diameter between 1.0 to 6.5 mm.

10. The lightweight cigarette filter as claimed in claim 1 wherein the filter element is of an annular shape surrounding said space filler.

11. A lightweight cigarette filter as claimed in claim 1 in which the filter is one of a dual and triple form filter, and the filter element extends for part of the total length of the filter.

12. A lightweight cigarette filter including a filter element containing fibrous filter material having a total Denier of less than 35,000 or a bulk density of less than 0.12 $gcm^{-3}$ in which part of the volume of the filter is occupied by a space filler which is substantially completely impervious to smoke flow therethrough and the bulk density of which is in the range from about 0.01 $gcm^{-3}$ to about 0.05 $gcm^{-3}$ and is less than the bulk density of the filter material.

* * * * *